United States Patent [19]

Wilkes, Jr. et al.

[11] 4,202,453

[45] May 13, 1980

[54] ARTICULATED MINE SERVICE VEHICLE

[75] Inventors: Ted W. Wilkes, Jr.; Darel L. Wentworth, both of Lander, Wyo.

[73] Assignee: Timberline, Inc., Lander, Wyo.

[21] Appl. No.: 867,126

[22] Filed: Jan. 5, 1978

[51] Int. Cl.[2] ..... B66C 23/06

[52] U.S. Cl. ..... 212/55; 180/235; 212/59 R

[58] Field of Search ..... 212/55, 59 R, 49; 180/14 A, 51, 52

[56] References Cited

U.S. PATENT DOCUMENTS

| | | | |
|---|---|---|---|
| 3,151,694 | 10/1964 | Rogers | 180/51 |
| 3,754,666 | 8/1973 | Suverkrop | 212/59 R |
| 3,807,586 | 4/1974 | Holopainen | 180/52 X |
| 4,050,535 | 9/1977 | Bosshart et al. | 180/51 |

*Primary Examiner*—Robert G. Sheridan

*Attorney, Agent, or Firm*—Sheridan, Ross, Fields & McIntosh

[57] ABSTRACT

A rugged maneuverable articulate mine service vehicle includes a power unit and a utility formed from welded steel plate, which units are interconnected by an articulated joint having a pivot axis and an axis of rotation. Each of the units has a pair of drive wheels with each drive wheel being powered by its own hydraulic motor. The power wheels are directly secured to the respective units. A hydraulic crane is pviotally mounted on the utility unit with the mast of the crane in close proximity to the articulated joint connecting the utility unit to the power unit. Hydraulic steering cylinders are connected between one of the units and the articulated joint and cause relative rotation of one unit of the vehicle about the pivot axis of the joint with respect to the other to steer the vehicle. Hydraulic outriggers are located at opposite corners of the front of the utility unit. An operator's compartment is located in the utility unit in which are located the controls needed to operate the vehicle and the crane to lift and carry extremely heavy loads particularly in places having restricted headroom such as in mine shafts and tunnels. The distribution of the motor, pump, reservoirs and the like in the power unit is chosen to locate the center of gravity of the units as far aft of the pivot axis as is reasonably possible while maintaining the overall height of the vheicle at a minimum. The power unit is pivoted with respect to the utility unit by the hydraulic steering cylinders to maximize its effect as a counterbalance to an object being lifted by the crane, particularly when the crane is lifting or holding an object to one side of the centerline of the utility unit.

5 Claims, 7 Drawing Figures

ARTICULATED MINE SERVICE VEHICLE

BACKGROUND OF THE INVENTION

1. Field of the Invention

This invention is in the field of articulated vehicles. The articulated mine service vehicle of the present invention is of rugged construction, has a low profile, is very powerful and maneuverable. Thus it is able to operate reliably and with a minimum of maintenance in underground mine shafts and tunnels. The vehicle is provided with a crane to lift and carry heavy loads, particularly in areas having limited headroom. The weight of the power unit is used as a maneuverable counterweight to the objects being lifted by its crane.

2. Description of the Prior Art

In the mining industry, particularly that pertaining to underground mines, the removal of desired ore or minerals and other rock or material with which it is found at the working faces in a mine, and the transfer of this mined material to the surface from the working faces is by powerful machines. The working faces of the mines are connected to vertical shafts provided with lifts, for example, by tunnels or shafts. For reasons of strength and safety and at the same time to minimize costs, the height and width of these shafts and tunnels and the working faces are limited to the minimum which will accommodate the machinery used. Another characteristic of such mines is that the surfaces of such shafts on which wheeled vehicles ride are very rough. Typically such shafts and tunnels are 10 feet wide and 8 feet high.

Because of the environment existing in most underground mines, there is a need for a compact, maneuverable, rugged and powerful vehicle to service the men and equipment working in them by transporting workers to locations where they are needed and for moving and servicing heavy machinery.

As a result of the nature of the machinery used, principally at the working faces of underground mines, there is a need for a vehicle with a crane mounted on it that can lift failed components such as motors, generators, etc. from such machines and transport the failed component to a repair facility. After the components are repaired or replaced, the vehicle transports the repaired components, or substitutes therefor, to the machine and aids in replacing them. The magnitude of the problem is better understood when it is realized that such mining machinery uses motors, diesel or electric, that weigh from four to six thousand pounds as the source of their power and that the height of the space in which these machines are located is normally no greater than 8 feet. Obviously it is more economical to take the failed components to a repair shop than to have to remove the machine of which the failed motor is a component to a place where repair facilities are located.

A problem in underground mines has been that mobile cranes that have the capacity to lift and carry weights in the four to ten thousand pound range are so massive and unmaneuverable that they frequently are not able to reach the working face, for example, where the machine is located or if they could reach the machine, then they are so big that because of the limited headroom there is not space for the crane to lift the load clear of the machine in which it is located. More maneuverable mobile cranes can reach the site where disabled equipment is located but are unable to lift and carry heavy loads.

PRIOR ART STATEMENT

The following references are submitted under the provisions of 37 CFR 1.97(b) and were found during a search conducted on behalf of applicant:

U.S. Pat. No. 3,669,281, Woodside et al
U.S. Pat. No. 3,754,666, Suverkrop
U.S. Pat. No. 3,912,300, Bryan Woodside et al (U.S. Pat. No. 3,669,281) discloses a crane having a rotatable mast, a main boom pivoted to the mast, a jib boom pivoted to the main boom, and an extension boom mounted in the jib boom.

Suverkrop (U.S. Pat. No. 3,754,666) discloses a folding crane which may be folded and lowered into position over the cab of a truck on which the crane is mounted. The truck is provided with hydraulically operated outriggers. A weighted hook is operatively connected to a winch mounted on the crane by a cable.

Bryan (U.S. Pat. No. 3,912,300) discloses an articulated vehicle in which two units of the vehicle are secured together by an articulated joint. Steering is accomplished by relative rotation of one unit with respect to the other about the pivot axis of the joint by appropriate energization of a pair of hydraulic steering cylinders.

SUMMARY OF THE INVENTION

The present invention provides an articulated mine service vehicle particularly adapted for use in underground mines. The vehicle has two units or sections, a power unit and a service unit, of substantially equal size which are secured together by an articulated joint. Eac of the units is provided with a pair of drive wheels provided with large diameter pneumatic tires. The drive wheels are directly attached to their respective units. The power unit is provided with a motor which in turn drives hydraulic pumps which energize the hydraulic motors with which each power wheel is provided. The units of the vehicle are formed from steel plate to provide ruggedness. As a result of the mass of the units, the action of the articulated joint, and the resiliency of the tires, the vehicle provides a relatively comfortable ride over the rough surfaces encountered in underground mine shafts at its normal speed of operation. The utility unit of the vehicle may be provided with a hydraulic crane, the mast of which is mounted for rotation about a normally vertical axis in close proximity to the articulated joint. The height of the mast, the length of the main boom and jib boom of the crane are chosen so that the crane can be folded when not in use so that it does not significantly increase the overall dimensions of the vehicle. The crane is provided with a hydraulic winch and a weighted hook. A pair of hydraulic outriggers are mounted at opposite front corners of the utility vehicle. Hydraulic steering cylinders are used to pivot one unit of the vehicle with respect to the other to steer the vehicle. An operator's compartment is provided in one of the units at which compartment is located the controls for operating the vehicle, the crane and the other components of the vehicle.

It is therefore an object of this invention to provide an articulated mine service vehicle which is of rugged construction, and is maneuverable, powerful and compact.

It is still another object of this invention to provide an articulated vehicle which has a crane mounted on the service unit of the vehicle and in which the lifting and carrying capacity of the vehicle is maximized.

It is yet another object of this invention to provide an articulated vehicle having a service unit and a power unit in which a crane is mounted on the service unit and in which the power unit serves as an adjustable stabilizing leg and counterweight for the crane.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENT

Figure 1:
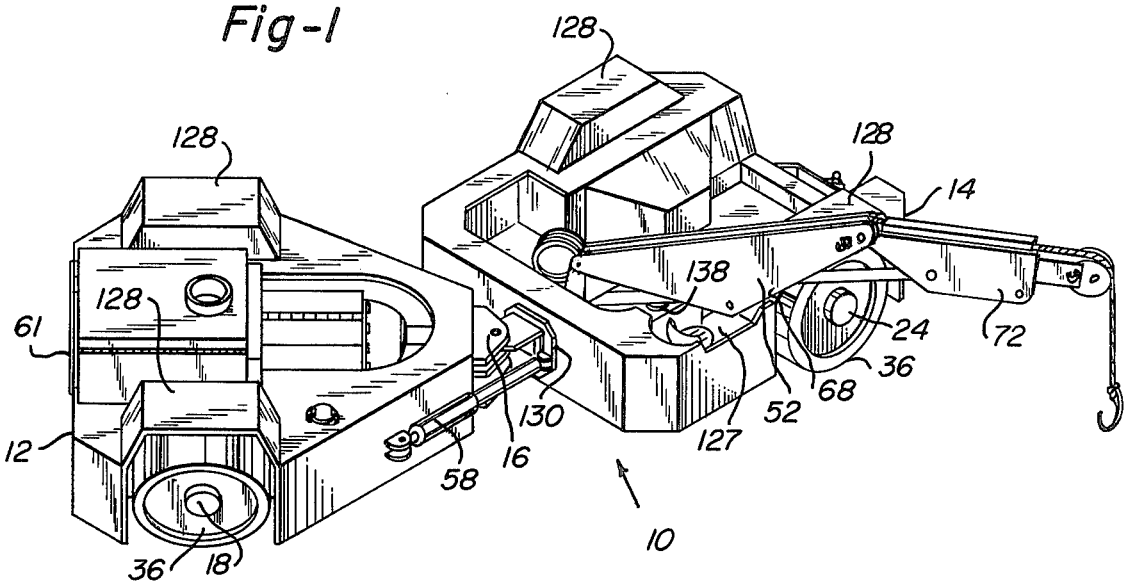
FIG. 1 is a perspective view of a preferred embodiment of the articulated mine service vehicle embodying this invention.
Figure 4:
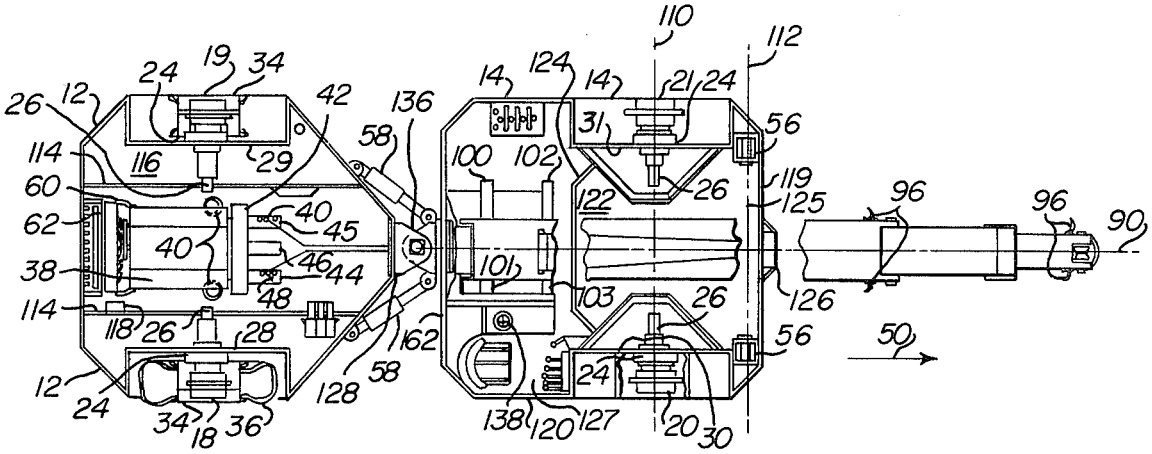
FIG. 4 is a plan view of the articulated vehicle with parts broken away to show details.
Figure 5:
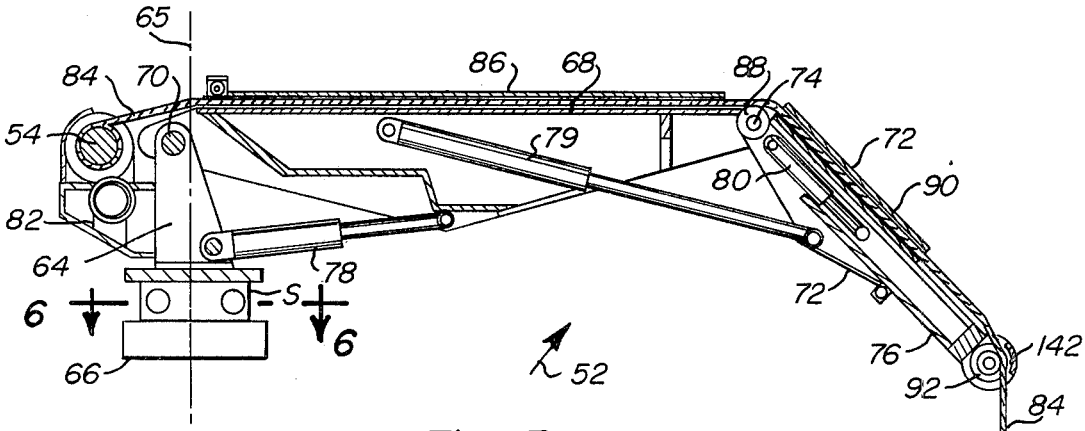
FIG. 5 is an enlarged sectional view of the crane.

In FIG. 1 articulated vehicle 10 has a power unit, or section, 12 and a utility unit, or section, 14 which are secured together, or interconnected, by an articulated joint 16. Power unit 12 has a pair of power wheels 18, 19 which are directly mounted on power unit 12 as is best illustrated in FIG. 4. Similarly, utility unit 14 has a pair of power wheels 20, 21 directly mounted on utility unit 14. Each of the power wheels 18–21 is provided with an automatic brake 24 and a fixed displacement hydraulic piston motor 26. The motors 26 are connected to their respective drive wheels by automatic brakes 24. The assembly of a power wheel 18, 19, 20 or 21 and its associated brake 24 and motor 26 are directly mounted on the units of vehicle 10 by the automatic brake 24 being bolted to a vertical wall of the units; for example, wheel 18's brake 24 is bolted to vertical wall 28 of power unit 12, wheel 19's brake 24 is bolted to vertical wall 29, and in a similar way the brakes 24 of wheels 20, 21 are bolted to vertical walls 30,31, respectively of utility unit 14. Each of the power wheels 18–21 has a split ring wheel 34 secured to it and a heavy-duty pneumatic tire 36 preferably having rock grip lugs is mounted on each wheel 34.

A conventional internal combustion motor, or engine, 38 is mounted on power unit 12. To minimize air pollution in a mine, engine 38, in a preferred embodiment, is a V-8 water-cooled four cycle diesel engine that develops 220 horsepower at 2800 rpm. To further reduce pollution, the exhaust gases from diesel engine 38 flow through a pair of catalytic converters 40 and are then vented to atmosphere below power unit 12. To provide hydraulic fluid under pressure, engine 38 is provided with a gear box transmission 42 which in a preferred embodiment drives three hydraulic pumps 44, 45 and 46. Pumps 44 and 45 are variable displacement piston pumps, or hydrastatic pumps, and are used to provide the hydraulic fluid under pressure to drive motors 26 by conventional hydraulic hoses which are not illustrated except symbolically in FIG. 7. Each of the pumps 44, 45 has a control lever 48 that controls the direction of flow of hydraulic fluid through drive motors 26 and thus determines whether vehicle 10 is going forward, the direction indicated by directional arrow 50 in FIG. 4, or backward. Hydraulic pump 46 is two high-pressure pumps packaged together and is the source of hydraulic power for crane 52, winch 54, outriggers 56 and steering cylinders 58.

Engine 38 which is liquid cooled is provided with a heavy-duty radiator 60 through which air is blown by a fan driven by engine 38. In addition an oil cooler 62 is provided to dissipate heat from the hydraulic fluid used to energize the various subsystems of vehicle 10. Oil cooler 62 is located just behind the radiator 60 of engine 38. Heavy-duty grill guard 63 is mounted at the rear of power unit 12 to reduce the risk of damage or injury to oil cooler 62 and radiator 60.

Utility unit 14 is provided with a crane 52. Crane 52 has a mast 64 which is mounted to rotate or swivel about crane pivot axis 65 on bushings around a large diameter kingpin which is mounted in the base 66 of crane 52. Base 66 is then in turn bolted to the floor or bottom wall 123 of utility unit 14.

Since this construction is conventional in mobile cranes and to simplify the drawings, the details of mounting crane 52 in unit 14 described above have been omitted from the drawings. Crane 52 is positioned on unit 14 so that crane pivot axis 65 is substantially vertical when unit 14 is level. Crane 52 has a main boom 68 which is pivotally mounted on the top of mast 64 by journal bearing 70. Jib boom 72 is pivotally mounted to main boom 68 by journal bearing 74. An extension boom is mounted for reciprocal linear movement in and out of jib boom 72. Main boom 68 can be raised or lowered by main boom hydraulic cylinder 78 which is pivotally mounted between mast 64 and main boom 68. Jib boom 72 can be raised and lowered by jib boom hydraulic cylinder 79 which is pivotally mounted between main boom 68 and jib boom 72. Extension boom 76 is retracted or extended into or out of jib boom 72 by extension boom hydraulic cylinder 80.

A hydraulic powered winch 54 is mounted on mast 64 by winch bracket 82 which is secured to mast 64 by welding, for example. A cable 84 is routed from winch 54 through cable guide and protector 86 over cable rollers 88 and through jib cable guide 90 and over end roller 92 of extension boom 76 to hook 94. The outer ends of the extension boom 76 and main boom 68 are provided with a pair of hooks, or horns 96 so the objects to be lifted by crane 52 can be secured to either extension boom 76 or main boom 68 by cables, for example.

Figure 6:
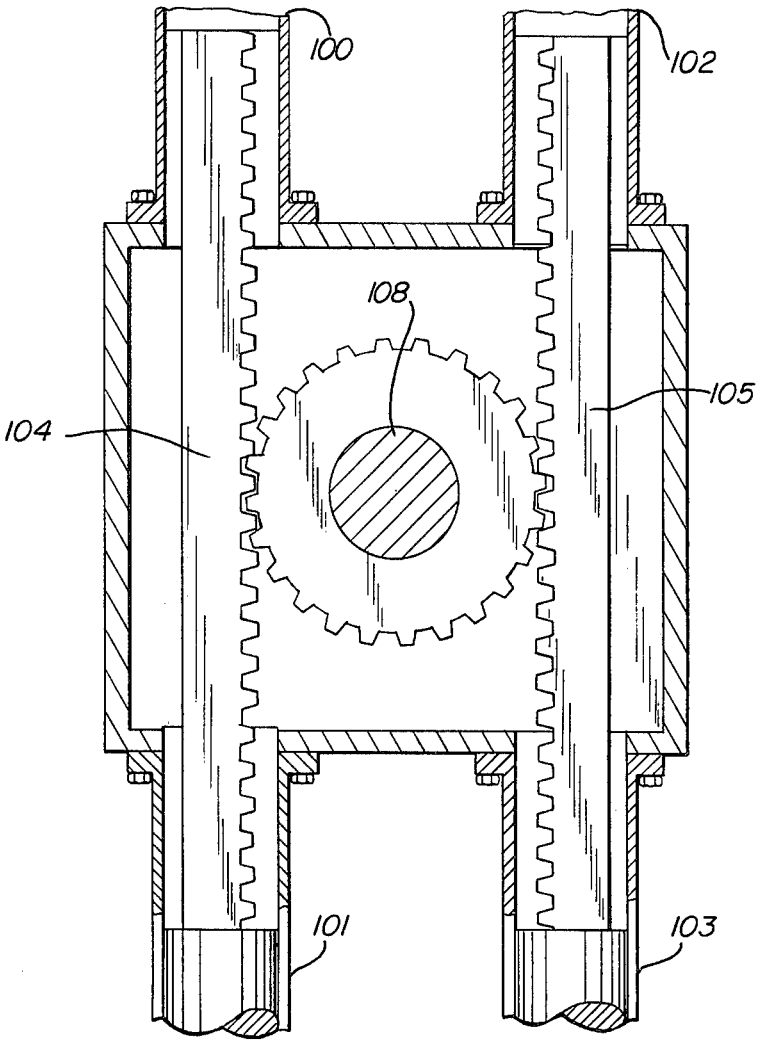
FIG. 6 is an enlarged sectional view taken on line 6—6 of FIG. 5.

In a preferred embodiment crane 52 can be swiveled or rotated about its pivot axis 65°±90° with respect to the centerline 98 of utility unit 14 by opposed pairs of hydraulic swing cylinders 100, 101, 102 and 103. Referring to FIG. 6, the pistons of cylinders 100, 101 are connected by rack 104 and the pistons of cylinders 102, 103 are connected by rack 105. The teeth of racks 104, 105 mesh with the teeth of pinion gear 106 which in turn is connected to shaft 108 to which mast 64 is secured. Thus, rotating shaft 108 through the action of the rack and pinion gears will rotate the crane 52. Appropriate energization of swing cylinders 100–103 will cause crane 52 to rotate in a clockwise or counterclockwise direction an amount determined by the direction displacement of the pistons in their respective cylinders.

Figure 2:
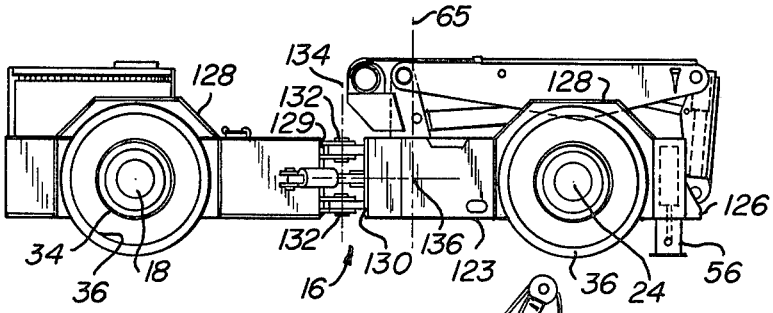
FIG. 2 is a side elevation of the articulated vehicle of the present invention with the crane in its folded position.
Figure 3:
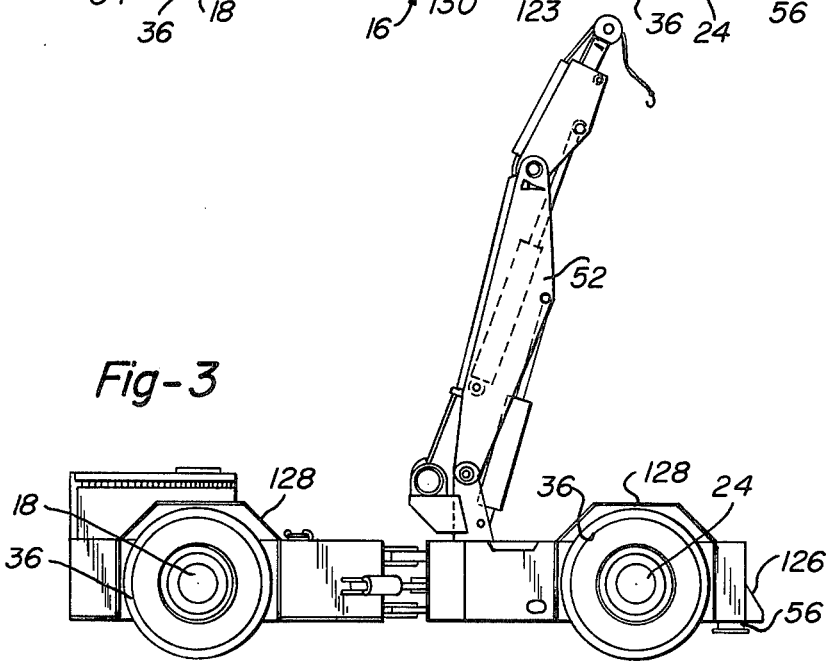
FIG. 3 is a view similar to that of FIG. 2 in which the main and jib booms of the crane are raised.

A pair of hydraulic outriggers 56 are mounted at opposite corners of the front of utility vehicle 14. When extended as illustrated in FIG. 2 they extend the axis about which moments are determined when crane 52 is lifting a weight, particularly when crane 52 is aligned with the centerline 98, for example, from the axis of rotation 110 of drive wheels 20, 21 of utility unit 14 to a line, or axis, 112 through the center of outriggers 50 which significantly increases the lifting capability of vehicle 10.

Power unit 12 and utility unit 14 are fabricated from steel plate preferably by welding and in a preferred embodiment the steel plates used are one inch in thickness which provide a vehicle whose ruggedness is such that it suffers little or no structural wear and tear even in the somewhat hostile environment of mines, particularly underground mines. In the power unit 12, stiffening walls 114 are used to form a fuel tank 116 and a hydraulic oil tank or reservoir 118. In utility unit 14, front wall 119, side walls 120, 121, rear wall 122, and bottom wall 123 substantially form a right parallelepiped, or the outline of utility unit 14 is substantially rectangular. Baffle 124 extends transversely across unit 14 and provides a storage compartment 125 for miscellaneous items and protects the swing cylinders 100–103 of crane 52 from threat of injury as well as protecting the hydraulic lines connected to crane 52. A towing pocket 126 is located at the front of utility unit 14 substantially on centerline 98 and in line with wall 123. An operator's compartment 127 is positioned within unit 14 alongside of crane 52. Each of the wheels is covered by a fender 128 which essentially protects the tires and wheels from injury from inadvertent contact with the side walls of a mine shaft, for example. In addition the motors 26 and brakes 24 for the drive wheels of utility unit 14 are provided with protective covers which are removable so that they can be worked on. It should be noted that engine 38 and other elements of power unit 12 are positioned well aft of the pivot axis 134 of articulated joint 16 which maximizes the effectiveness of power unit 12 as a counterweight to any load picked up by crane 52.

It also should be noted that the crane 52 is mounted in utility unit 14 so that crane axis 65 substantially intersects centerline 98 of utility unit 14 and is substantially close to, or is in close proximity to articulated joint 16. It should be noted that the axis of rotation 110 of the drive wheels of utility unit 14 are well forward toward front wall 119 while the tires 36 remain within the substantially rectangular outlines of the unit. The location of the drive wheels on the utility unit maximize the ability of vehicle 10 to transport a heavy object suspended from crane 52.

Articulated joint 16 has two halves or portions 129, 130 which are pivotally secured together by two large diameter pins 132 so that units 12, 14 can pivot or rotate about joint pivot axis 134. Portion 129 of joint 16, in a preferred embodiment, is rigidly secured to power unit 12 so that pivot axis 134 is substantially vertical when vehicle 10 is level. Utility unit 14 is secured to portion 130 of articulated joint 16 by a bearing or journal so that unit 14 can rotate around roll axis 136 of joint 16 which substantially coincides with centerline 98 in FIG. 4.

Figure 7:
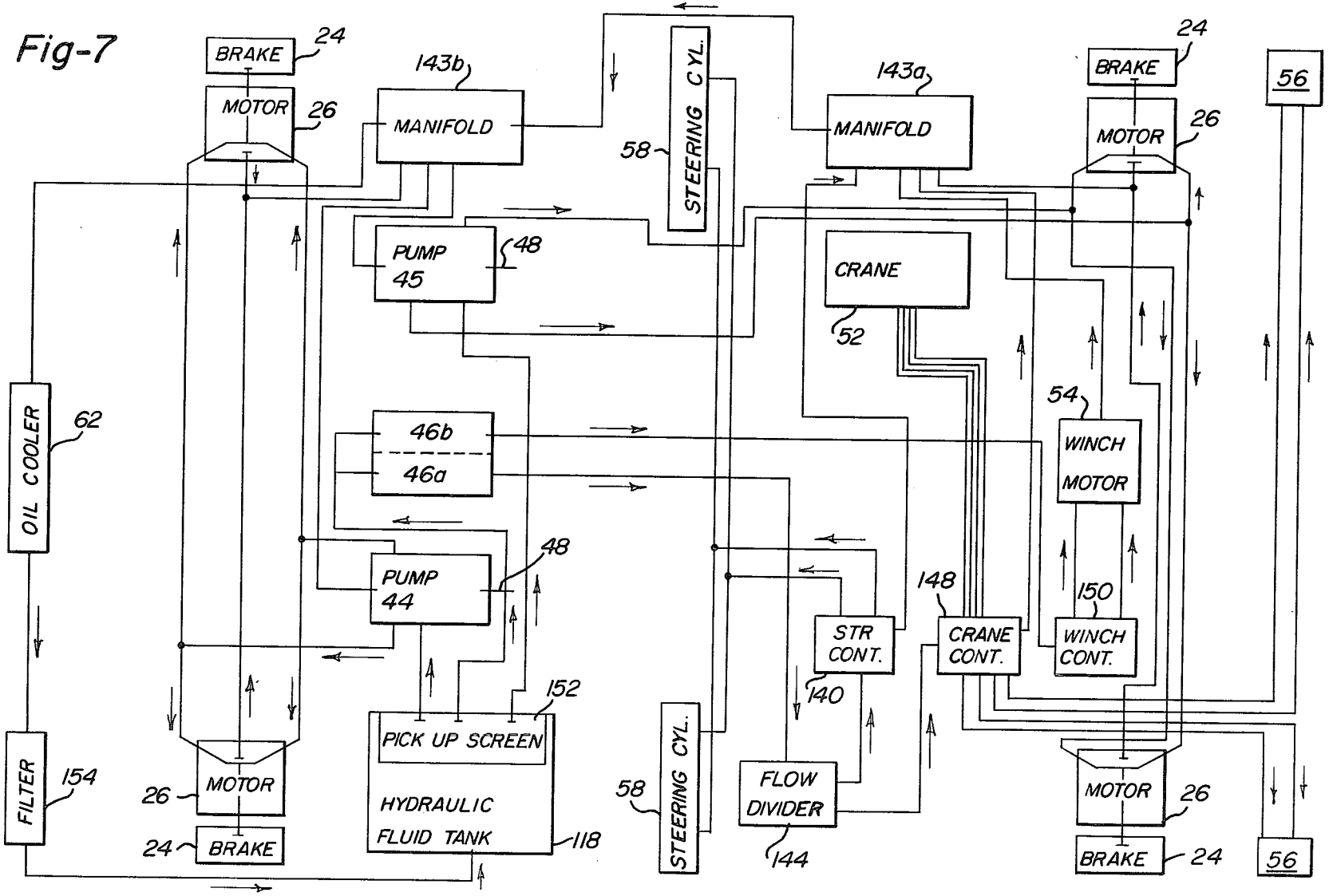
FIG. 7 is a schematic diagram of the hydraulic system of the articulated vehicle.

Steering of vehicle 10 is accomplished by the operator while sitting in compartment 127 by means of steering wheel 138 which is connected to an orbital steering valve 140 which is illustrated schematically in FIG. 7. Valve 140 controls the energization of hydraulic steering cylinders 58, one end of each of which is pivotally secured to power unit 12 and the other end of which is pivotally secured to portion 130 of articulated joint 16. In a preferred embodiment one unit of vehicle 10 can pivot with respect to the other about the joint pivot axis 134°±40°.

Referring now to FIG. 7, hydraulic lines, or hoses, are illustrated as lines connecting various elements of the hydraulic system. Direction of flow in the hoses is shown by arrows alongside the lines. With respect to hydraulic cylinders such as steering cylinders 58, outriggers 56 and those of crane 52, the pistons of such cylinders are displaced by pressurized hydraulic fluid flowing through one high pressure hose with fluid on the nonpressurized side of the piston returning to the control valve through the other high pressure hose. Pumps 44 and 45 are used to power the motors 26 of power wheels 18–21. Each of pumps 44, 45 has a gear selector lever 48 that controls the direction of flow of oil to motors 26 and thus the direction of rotation of wheels 18–21. The position of levers 48 of hydraulic pumps 44, 45 are controlled from the operator's compartment and can be mechanically or electrically controlled or positioned from there. Brakes 24 are applied, or set, to prevent rotation of the power wheels 18–21 at any time that the levers 48 are placed in neutral. Return flow from motors 26 flows into manifold 143*a* or 143*b* which are interconnected by a low-pressure hydraulic hose or line as illustrated in FIG. 7.

Pumps 46 supply hydraulic fluid to be applied to steering cylinders 58, to crane 52, and to winch 54. Fluid from pump 46*a* flows to flow divider 144 and from flow divider 144 to orbital steering control valve 140 which controls the flow of oil to steering cylinders 58. Return flow is through a low pressure line from valve 140 to manifold 143*a*. Fluid from flow divider 144 also flows to crane control valve 148. Crane control valves 148 control the flow of hydraulic fluid to the hydraulic cylinders 78, 79, 80 and swing cylinders 100–103 used to raise, lower, extend and retract extension boom 76 of crane 52 and to rotate crane 52. To simplify FIG. 7, hydraulic cylinders 78–80 and 100–103 of crane 52 are not illustrated. Crane control valve 148 also is provided with the valves needed to raise and lower outriggers 56. Return flow from crane control valve 148 flows into manifold 143*a*.

Pump 46*b* provides the pressurized hydraulic fluid for winch 54. Control of winch 54, its direction of rotation, for example, is by winch control valve 150. Return flow from winch 54 also flows into manifold 143*a*.

Pumps 44 and 45 draw hydraulic oil, or fluid, from manifold 143*b* and from hydraulic fluid tank 118 through pickup screens 152 located in tank 118 and conventional hydraulic lines connecting pumps 45 and 46 to screens 152. Pumps 46*a*, 46*b* only draw hydraulic fluid from tank 118. Hydraulic oil returns to tank 118 from manifold 143*b* through oil cooler 62 and hydraulic oil filter 154. It should be noted that all controls for vehicle 10, including the conventional controls of self-starting diesel engine 38, steering controls 140, crane controls 148 and winch control 150 are located in operator's compartment 127.

In a preferred embodiment vehicle 10 has a length of 18′ 6″ with crane 52 folded as illustrated in FIG. 2, a width of 8′ 2″ with the crane forward, a height of 5′ 4″, the maximum height occurring at the winch 54 when the crane, main boom and jib booms are depressed. The lengths of power unit 12 and utility unit 14 measured from pivot axis 134 are substantially the same. The gross weight of the vehicle is substantially 28,350 pounds. The vehicle has a turning radius of 16 feet and its maximum operating speed is 6 miles per hour. Wheels 34 have a diameter of 20" and the size of the tires 36 is 1200 by 20 by 18 ply. The power wheels are provided with gears which provide a 40 to 1 reduction. Winch 54, in a preferred embodiment, has a capacity of 10,000 pounds. Outriggers 56 each has a capacity of 18,000 pounds. Crane 52 has a lifting capacity of 30,000 pounds with outriggers 56 deployed and can pick and carry 15,000 pounds when crane 52 is fully extended.

When vehicle 10 is moving from one location to another in a mine, for example, and its crane is not in use, crane 52 is normally folded with the remote end 142 of extension boom 76 positioned in towing pocket 122. The length of main boom 68 substantially equals that of utility unit 14, and the length of jib boom 72 and extension boom 76 when retracted substantially equals the height of mast 64. As a result the vertical profile of vehicle 10 is compact and low.

Not withstanding that the power wheels 18–21 are directly mounted on the units of vehicle 10, vehicle 10 rides steadily and comfortably over rough surfaces at its designed operating speed. It is believed that this is due to the large mass of the vehicle, the fact that the units can rotate about the roll axis 136 of articulated joint 16 which gives vehicle 10 some of the stability features of a three-wheel vehicle while pneumatic tires 36 absorb some of the forces that would otherwise be transmitted to vehicle 10 and its occupants. Thus the vehicle 10 provides a rugged, powerful, reasonably comfortable vehicle for use in mines.

When crane 52 is deployed it can be rotated ±90° with respect to the centerline 98 of utility unit 14. Main boom 68 can be raised or lowered by main boom hydraulic cylinder 78. Similarly jib boom 72 can be raised or lowered by jib cylinder 79 and extension boom 76 can be extended or retracted by extension boom hydraulic cylinder 80.

In most underground mines where powerful machinery is used in the mining operation an eight-foot ceiling is commonly provided. Extension boom 76 measures substantially less than one foot, in the vertical direction, so it can be positioned above most mine machinery and still provide enough clearance to remove a repairable subsystem of such mine machinery. While winch 54 has a capacity of 10,000 pounds in the preferred embodiment, crane 52 can lift or hold loads up to three times greater weight than that which could be lifted by the winch alone by attaching the load to hooks, or horns, 96 on main boom 68 or on extension boom 76 so that the load can be taken by the hydraulic cylinder 78, 79.

Vehicle 10, because it is articulated, is very maneuverable. Because it is so maneuverable and has such a low profile, it can much more frequently than conventional vehicles approach a load to be picked up so that crane 52 is essentially pointed straight ahead or aligned with centerline 98, the condition in which vehicle 10 can lift its maximum load. However, where this is not possible, and crane 52 must be rotated to one side or the other to reach the object to be lifted, vehicle 10 can be maneuvered so that power unit 12 is turned or positioned to counterbalance the load as is illustrated in FIG. 1, for example. As a result a significantly greater load can be picked up than otherwise would be the case. Thus power unit 12 serves as a manuverable counterbalance and stabilizing third leg for crane 52 which maximizes the load vehicle 10 can lift.

While articulated mine surface vehicle 10 has been described primarily in terms of its use as a mobile crane, it can be used for other things such as transporting personnel, carrying supplies or a diesel electric power generator can be mounted in the utility unit in place of crane 52, so that vehicle 10 can serve as a portable electric power supply.

The operator's compartment can be located in either service unit 14 or in power unit 12 and what is the nominal front or rear of the vehicle is principally determined by the position and layout of the operator's compartment.

From the foregoing it should be evident that various modifications can be made to the described invention without departing from the scope of the present invention.

What is claimed is:

1. An articulated mine service vehicle comprising:
a power unit fabricated of steel plate;
an engine mounted in said unit;
hydraulic pump means operatively connected to said engine;
a first pair of drive wheels directly secured to said unit on opposite sides thereof;
a utility unit fabricated of steel plate and having front, rear, bottom and side walls, which walls substantially define a right parallelepiped;
a second pair of drive wheels directly secured to said utility unit on opposite sides thereof;
a hydraulic motor operatively connected to each wheel;
hydraulic brake means operatively connected to each power wheel;
a pneumatic tire mounted on each power wheel;
an articulated joint having a pivot axis and a roll axis, said joint being rigidly secured to said power unit so that its pivot axis is substantially vertical when the vehicle is level, and secured by bearing means to said utility unit so that the utility unit can rotate relative to the power unit around said roll axis;
hydraulic steering cylinders for causing one unit to pivot with respect to the other unit about the pivot axis of said joint;
a crane having a mast, said mast having a pivot axis;
a main boom pivotally mounted on said mast;
hydraulic means for raising, lowering the main boom;
a jib boom pivotally mounted on said main boom;
hydraulic means for raising and lowering the jib boom;
an extension boom reciprocally mounted in said jib boom, one end of said extension boom projecting beyond said jib boom;
hydraulic means for extending and retracting said extension boom;
a hydraulic powered winch mounted on said mast;
a weighted hook;
cable means for connecting the weighted hook to the winch, said hook hanging from said one end of the extension boom;
means for mounting the mast of said crane in said utility unit so that said mast can pivot about its pivot axis, so that said pivot axis of said mast is substantially vertical when said utility unit is level, and so that said pivot axis substantially intersects the centerline of said utility unit, said mast being located within the utility unit substantially as close to the articulated joint as possible;

hydraulic powered pivot means for causing the mast of the crane to pivot about is pivot axis;

a pair of hydraulic outriggers located substantially at the intersection of the front and side walls of said utility unit, remote from said articulated joint;

an operator's compartment in the utility unit;

first hydraulic power transmission means for applying hydraulic fluid under pressure from the hydraulic pump means to the hydraulic motors operatively connected to said drive wheels and to the brake means for each power wheel;

second hydraulic power transmission means for applying hydraulic fluid under pressure from the hydraulic pump means to the hydraulic steering cylinders;

third hydraulic power transmission means for applying hydraulic fluid under pressure from the hydraulic pump means to the hydraulic means of the crane, to the winch, and to the outriggers;

control means for controlling the engine;

control means for controlling the first, second and third hydraulic power transmission means, said control means being located in the operator's compartment.

2. The vehicle of claim 1 in which the engine is a diesel engine.

3. The vehicle of claim 2 in which the lengths and widths of the power unit and the utility units are substantially the same.

4. The vehicle of claim 1 in which a towing pocket is mounted on the front of the utility unit substantially in alignment with the centerline of the unit and the bottom wall of the unit.

5. The vehicle of claim 4 in which the length of the main boom substantially equals the length of the utility unit, the length of the jib boom with the extension boom retracted substantially equals the height of the mast, whereby when the end of the extension boom is placed in the towing pocket, the main boom is substantially parallel to the bottom wall of the utility unit and the jib boom is substantially vertical.

* * * * *